US010070767B2

(12) United States Patent
Chang

(10) Patent No.: US 10,070,767 B2
(45) Date of Patent: Sep. 11, 2018

(54) ELECTRICAL AND FOOT-OPERATED DEWATER DEVICE

(71) Applicant: Kuei-Mao Chang, Kaohsiung (TW)

(72) Inventor: Kuei-Mao Chang, Kaohsiung (TW)

( * ) Notice: Subject to any disclaimer, the term of this patent is extended or adjusted under 35 U.S.C. 154(b) by 0 days.

(21) Appl. No.: 15/414,635

(22) Filed: Jan. 25, 2017

(65) Prior Publication Data

US 2017/0215688 A1 Aug. 3, 2017

(51) Int. Cl.
*A47L 13/58* (2006.01)

(52) U.S. Cl.
CPC ..... *A47L 13/58* (2013.01)

(58) Field of Classification Search
CPC ..... A47L 13/58
USPC ..... 15/260, 263; 210/236, 403
See application file for complete search history.

(56) References Cited

U.S. PATENT DOCUMENTS

2006/0048330 A1* 3/2006 Rust ..... A47L 13/58 15/260
2010/0180460 A1* 7/2010 Tang ..... A47L 13/254 34/58

* cited by examiner

*Primary Examiner* — Christopher M Koehler
*Assistant Examiner* — Stephanie Berry

(57) ABSTRACT

An electrical and foot-operated dewater device contains: a bucket, a dewatering unit, and a draining basket. The bucket includes a holding portion and a groove portion. The dewatering unit includes a base, a rotary shaft rotatably, a foot-operated driving assembly, a first touch switch, and an electrical driving assembly. The rotary shaft includes a first gear portion and a second gear portion, the foot-operated driving assembly includes a transmission part, a first pedal, and a resilient element, wherein the transmission part has a worm, a fitting sleeve, and a drive gear. The electrical driving assembly includes a motor, a circuit controller, a battery, and a control switch. The circuit controller includes a charging circuit module which has a socket configured to connect with an external power supply so as to electrify the battery, and the charging circuit module receives electricity produced by the motor in a foot-operated driving mode.

3 Claims, 6 Drawing Sheets

ELECTRICAL AND FOOT-OPERATED DEWATER DEVICE

FIELD OF THE INVENTION

The present invention relates to a dewater device, and more particularly to an electrical and foot-operated dewater device.

BACKGROUND OF THE INVENTION

A conventional dewater device is foot-operated so as to remove wastewater from a mop, but it has to be stepped repeatedly by user's foot, thus causing using inconvenience.

The present invention has arisen to mitigate and/or obviate the afore-described disadvantages.

SUMMARY OF THE INVENTION

The primary objective of the present invention is to provide an electrical and foot-operated dewater device which is operated in a foot-operated driving mode and an electrical driving mode.

To obtain the above objective, an electrical and foot-operated dewater device provided by the present invention contains: a bucket, a dewatering unit, and a draining basket.

The bucket includes a holding portion and a groove portion, the groove portion is separated from the holding portion.

The dewatering unit is mounted in the groove portion of the bucket, and the dewatering unit includes a base, a rotary shaft rotatably fixed on the base, a foot-operated driving assembly configured to drive the rotary shaft to revolve, a first touch switch, and an electrical driving assembly.

The draining basket is housed in the holding portion of the bucket and is rotatably connected with the rotary shaft.

The rotary shaft includes a first gear portion and a second gear portion, the foot-operated driving assembly includes a transmission part, a first pedal, and a resilient element, wherein the transmission part has a worm, a fitting sleeve, and a drive gear, wherein the worm is rotatably fixed on the base, the fitting sleeve is fitted on the worm, and the resilient element is fitted on the worm and is located below the fitting sleeve, the drive gear is disposed on one end of the worm and meshes with the first gear portion of the rotary shaft, and the first pedal is configured to drive the transmission part.

The first touch switch is secured below the first pedal.

The electrical driving assembly is configured to drive the rotary shaft to revolve, and the electrical driving assembly includes a motor, a circuit controller, a battery, and a control switch, wherein the motor meshes with the second gear portion of the rotary shaft, and the motor includes a coupling post and an actuation gear meshing with the second gear portion of the rotary shaft, wherein the circuit controller is electrically connected with the motor and the first touch switch, the battery is electrically connected with the circuit controller, and the control switch is electrically connected with the circuit controller so as to switch an electrical driving mode and a foot-operated driving mode.

The circuit controller includes a charging circuit module, the charging circuit module includes a socket configured to connect with an external power supply so as to electrify the battery, and the charging circuit module receives electricity produced by the motor in the foot-operated driving mode.

DETAILED DESCRIPTION OF THE FIRST EMBODIMENTS

Figure 1:
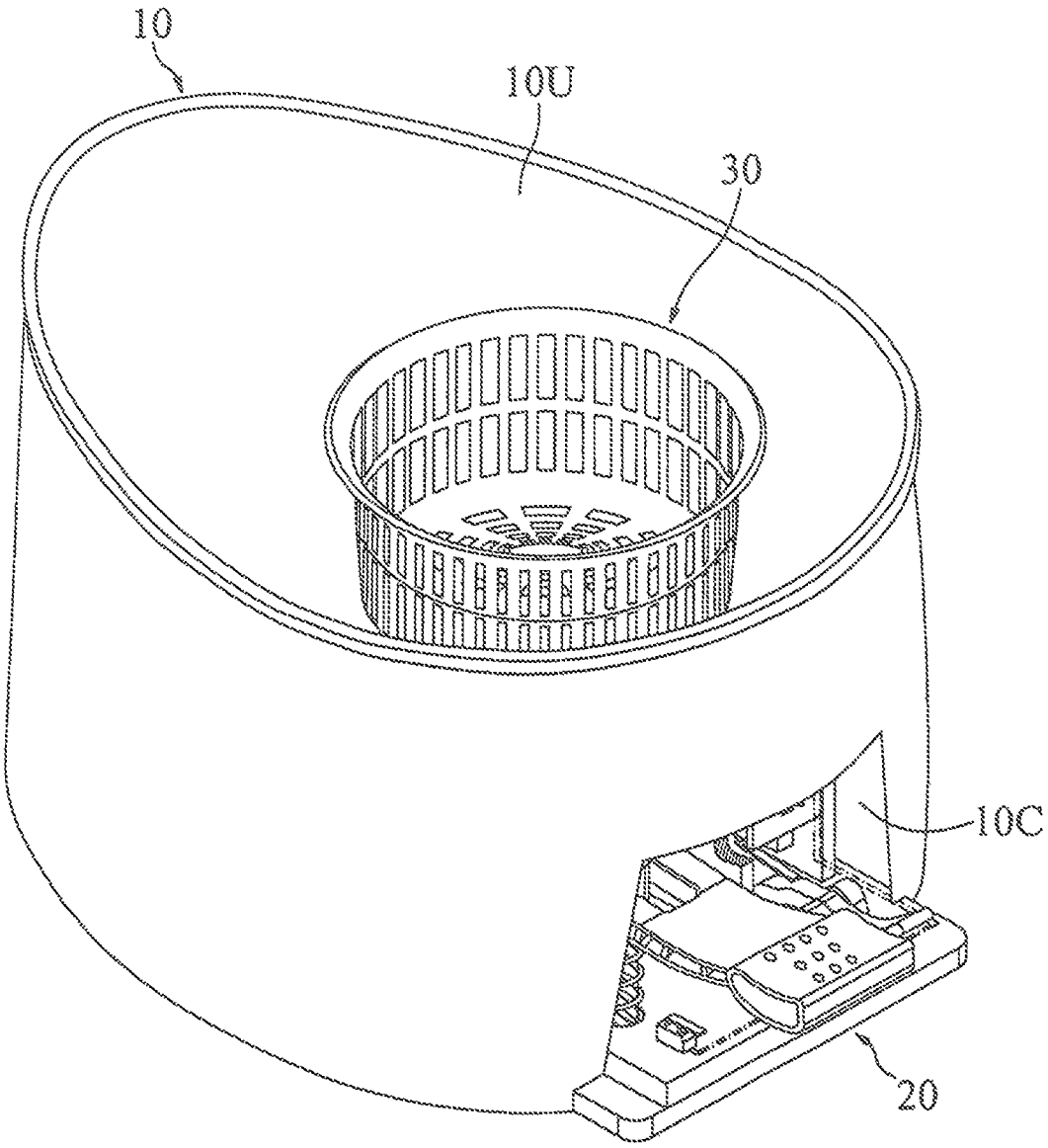
FIG. 1 is a perspective view showing the assembly of an electrical and foot-operated dewater device according to a preferred embodiment of the present invention.
Figure 2:
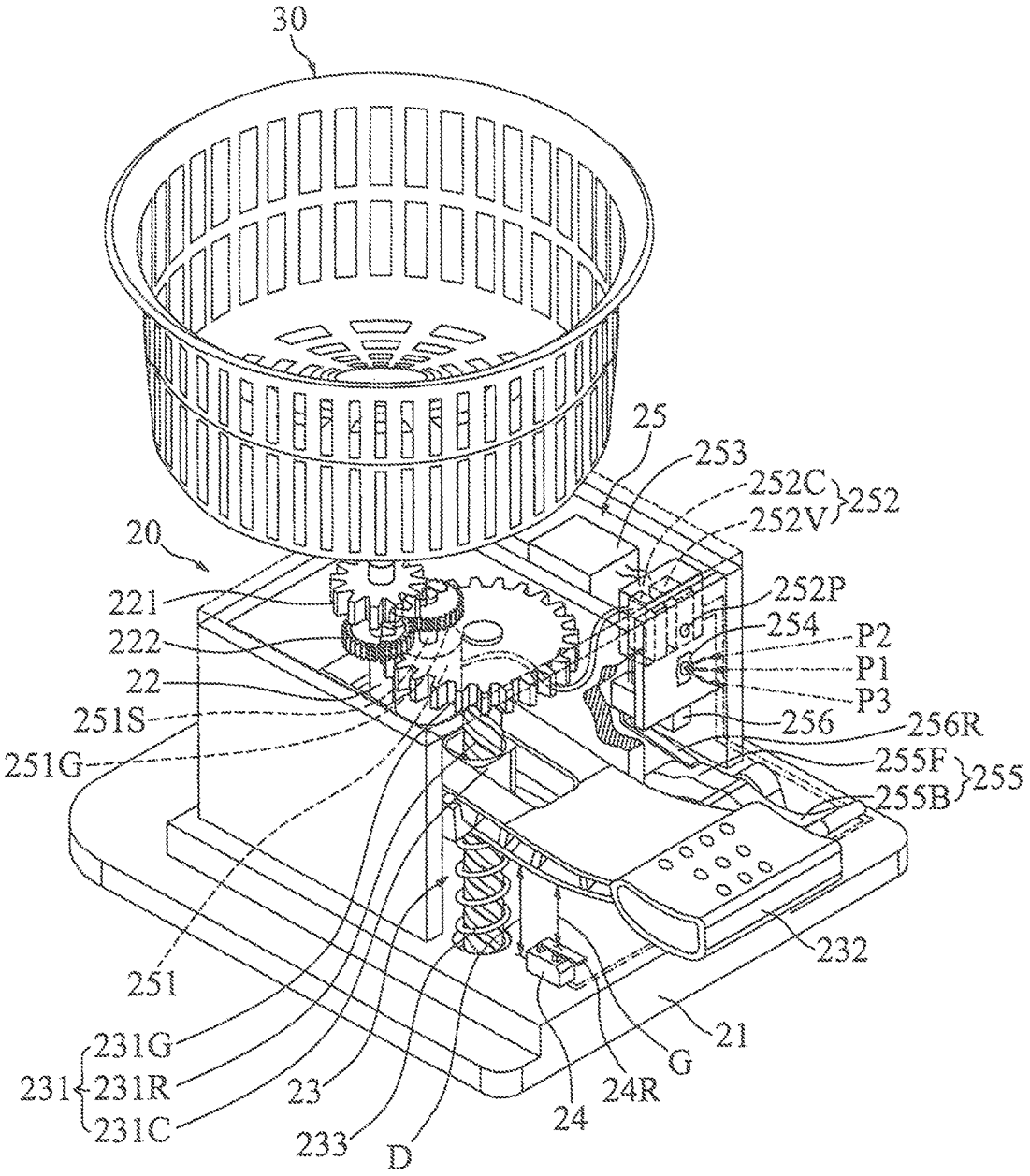
FIG. 2 is a perspective view showing the assembly of a part of the electrical and foot-operated dewater device according to the preferred embodiment of the present invention.

With reference to FIGS. 1 and 2, an electrical and foot-operated dewater device 1 according to a preferred embodiment of the present invention comprises: a bucket 10, a dewatering unit 20, and a draining basket 30.

The bucket 10 includes a holding portion 10U and a groove portion 10C. The holding portion 10U is configured to hold wastewater removed from a mop. The groove portion 10C is separated from the holding portion 10U so as to prevent the wastewater flowing into the groove portion 10C from the holding portion 10U.

The dewatering unit 20 is mounted in the groove portion 10C of the bucket 10, and the dewatering unit 20 includes a base 21, a rotary shaft 22, a foot-operated driving assembly 23, a first touch switch 24, and an electrical driving assembly 25.

The rotary shaft 22 is rotatably fixed on the base 21, and the rotary shaft 22 includes a first gear portion 221 and a second gear portion 222.

The foot-operated driving assembly 23 is configured to drive the rotary shaft 22 to revolve, and the foot-operated driving assembly 23 includes a transmission part 231, a first pedal 232, and a resilient element 233.

The transmission part 231 meshes with the first gear portion 221 of the rotary shaft 22. In this embodiment, the transmission part 231 has a worm 231R, a fitting sleeve 231C, and a drive gear 231G, wherein the worm 231R is rotatably fixed on the base 21, the fitting sleeve 231C is fitted on the worm 231R, and the drive gear 231G is disposed on one end of the worm 231R and meshes with the first gear portion 221 of the rotary shaft 22.

The first pedal 232 is configured to drive the transmission part 231. In this embodiment, the first pedal 232 is pressed so as to force the fitting sleeve 231C, and the fitting sleeve 231C drives the worm 231R to rotate, thereafter the drive gear 231G is driven by the worm 231R to revolve. In the meantime, the first gear portion 221 is actuated by the drive gear 231G so as to rotate and to drive rotation of the rotary shaft 22.

The resilient element 233 is fitted on the worm 231R and is located below the fitting sleeve 231C. In this embodiment, when the first pedal 232 is pressed downwardly to force the fitting sleeve 231, the resilient element 233 is pressed by the fitting sleeve 231 and returns back to the fitting sleeve 231C and the first pedal 232.

The first touch switch 24 is secured below the first pedal 232. In this embodiment, the first touch switch 23 includes a first control lever 24R defined between the first pedal 232 and the base 21.

Between the first control lever 24R and the first pedal 232 is defined a spacing G, and between the first pedal 232 and the base 21 is defined a moving distance D. Preferably, the spacing G is less than the moving distance D so that when the first pedal 232 moves toward a lowest position, it touches the first touch switch 24.

The electrical driving assembly 25 is configured to drive the rotary shaft 22 to revolve, and the electrical driving assembly 25 includes a motor 251, a circuit controller 252, a battery 253, and a control switch 254.

The motor 251 meshes with the second gear portion 222 of the rotary shaft 22. In this embodiment, the motor 251 includes a coupling post 251S and an actuation gear 251G meshing with the second gear portion 222 of the rotary shaft 22. Preferably, the motor 251 is an inverter motor or a servomotor.

The circuit controller 252 is electrically connected with the motor 251 and the first touch switch 24. In this embodiment, the circuit controller 252 includes a speed circuit module 252V and a charging circuit module 252C.

The speed circuit module 252V controls a rotation speed of the motor 251. In this embodiment, the speed circuit module 252V includes a constant-speed control circuit. In another embodiment, the motor 251 is a constant-speed motor, thus eliminating the speed circuit module 252V.

The charging circuit module 252C electrifies electricity to the battery 253. In this embodiment, the charging circuit module 252C has a socket 252P configured to connect with an external power supply (not shown) so as to electrify the battery 253 by way of the external power supply.

The charging circuit module 252C allows receiving electricity produced by the motor 251 in a foot-operated driving mode, and the electricity is supplied to the battery 253.

The battery 253 is electrically connected with the circuit controller 252 so as to supply electricity to the motor 251 in an electrical driving mode.

The control switch 254 is electrically connected with the circuit controller 252 so as to switch the electrical driving mode and the foot-operated driving mode. In this embodiment, the control switch 254 has a first actuation position P1 and a second actuation position P2.

The first actuation position P1 corresponds to the foot-operated driving mode, for example, when the control switch 254 is set at the first actuation position P1, the dewater device 1 is operated in the foot-operated driving mode.

The second actuation position P2 corresponds to the electrical driving mode, for example, when the control switch 254 is set at the second actuation position P2, the dewater device 1 is operated in the electrical driving mode. In this embodiment, the first touch switch 24 matches with the first pedal 232 so as to start the electrical driving mode. For example, when the actuation gear 251G of the motor 251 rotates in the electrical driving mode, it drives the rotary shaft 22 to revolve.

It is to be noted that when the first pedal 232 presses the first touch switch 24 to start the electrical driving mode, user's foot has to lift on the ground so as to pedal the first pedal. To start the electrical driving mode, the electrical driving assembly 25 further includes a second pedal 255 and a second touch switch 256.

Figure 3:
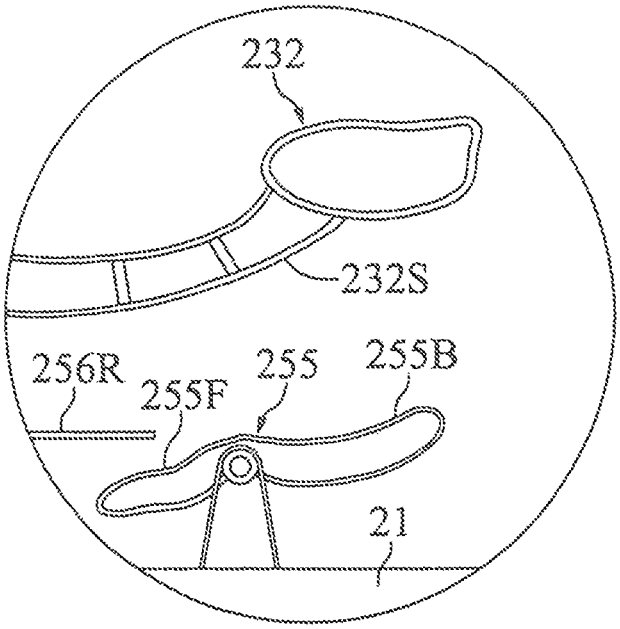
FIG. 3 is a side plane view showing the assembly of a part of the electrical and foot-operated dewater device according to the preferred embodiment of the present invention.

Referring to FIGS. 2 and 3, the second pedal 255 is arranged on the base 21, and the second pedal 255 has a front stepping portion 255F and a rear stepping portion 255B. In this embodiment, the rear stepping portion 255B of the second pedal 255 is lower than a bottom plane 232S of the first pedal 232 so as to be pedaled by a user which cannot lift foot.

The second touch switch 256 corresponds to the second pedal 255 and is electrically connected with the circuit controller 252. In this embodiment, the second touch switch 256 mates with the second pedal 255 so as to start the electrical driving mode.

Preferably, the second touch switch 256 has a second control lever 256R located above the front stepping portion 255F. When the user pedals the rear stepping portion 255B, the front stepping portion 255F moves upwardly so as to press the second control lever 256R, thus starting the electrical driving mode.

Furthermore, the control switch 254 further has a third actuation position P3 corresponding to the electrical driving mode, wherein the second pedal 255 presses the second touch switch 256 so as to start the electrical driving mode.

Referring to FIGS. 1 and 2, the draining basket 30 is housed in the holding portion 10U of the bucket 10 and is rotatably connected with the rotary shaft 22, hence when the rotary shaft 22 rotates, it drives the bucket 30 to revolve.

Figure 4:
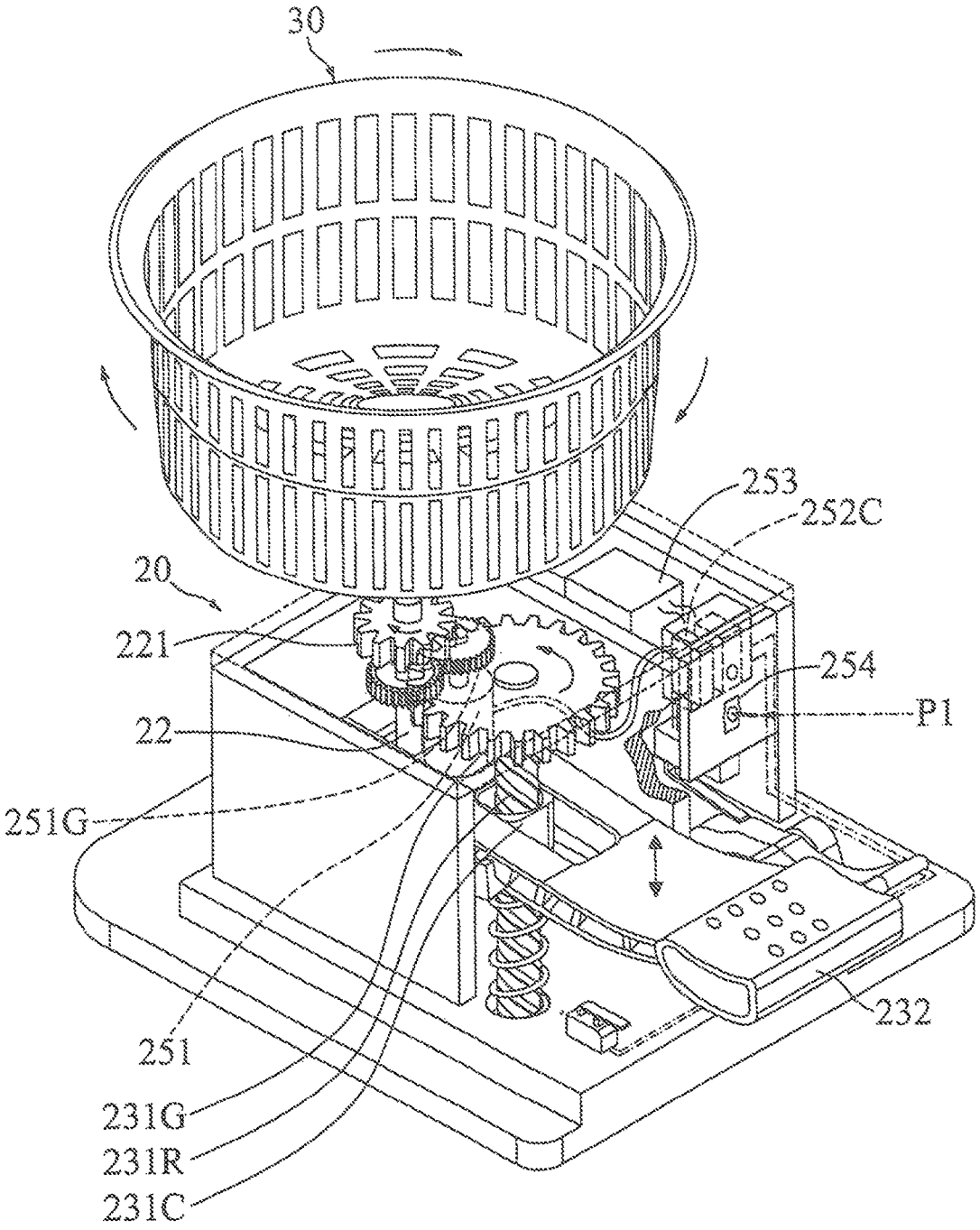
FIG. 4 is a perspective view showing the operation of the electrical and foot-operated dewater device at a first actuation position according to the preferred embodiment of the present invention.

As shown in FIG. 4, when the control switch 254 is set at the first actuation position P1, the dewater device 1 is operated in the foot-operated driving mode. For instance, the first pedal 232 is stepped by the user so as to drive the worm 231R and the drive gear 231G to revolve, and the worm 231R and the drive gear 231G actuate the rotary shaft 22 and the bucket 30 to rotate. In addition, the rotary shaft 22 drives the actuation gear 251G of the motor 251 to rotate so that the motor 251 produces the electricity, and the electricity electrifies back to battery 253 via the charging circuit module 252C.

Figure 5:
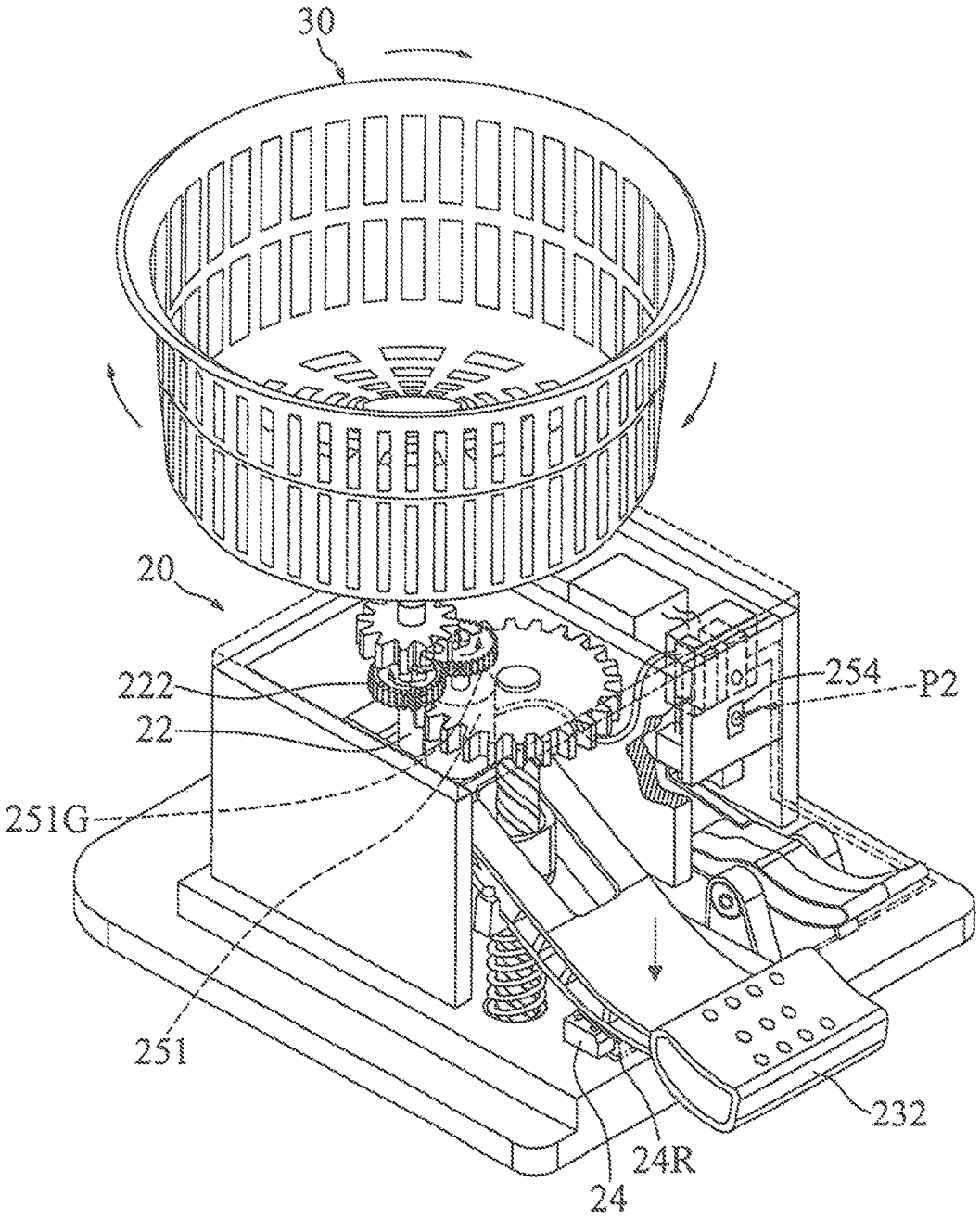
FIG. 5 is a perspective view showing the operation of the electrical and foot-operated dewater device at a second actuation position according to the preferred embodiment of the present invention.

As illustrated in FIG. 5, when the control switch 254 is set at the second actuation position P2, the dewater device 1 is operated in the electrical driving mode. For example, the first pedal 232 is stepped by the user so that the first pedal 232 presses the first control lever 24R of the first touch switch 24, thus starting the electrical driving mode. Thereafter, the actuation gear 251G of the motor 251 rotates so as to drive the rotary shaft 22 and the bucket 30 to revolve.

Figure 6:
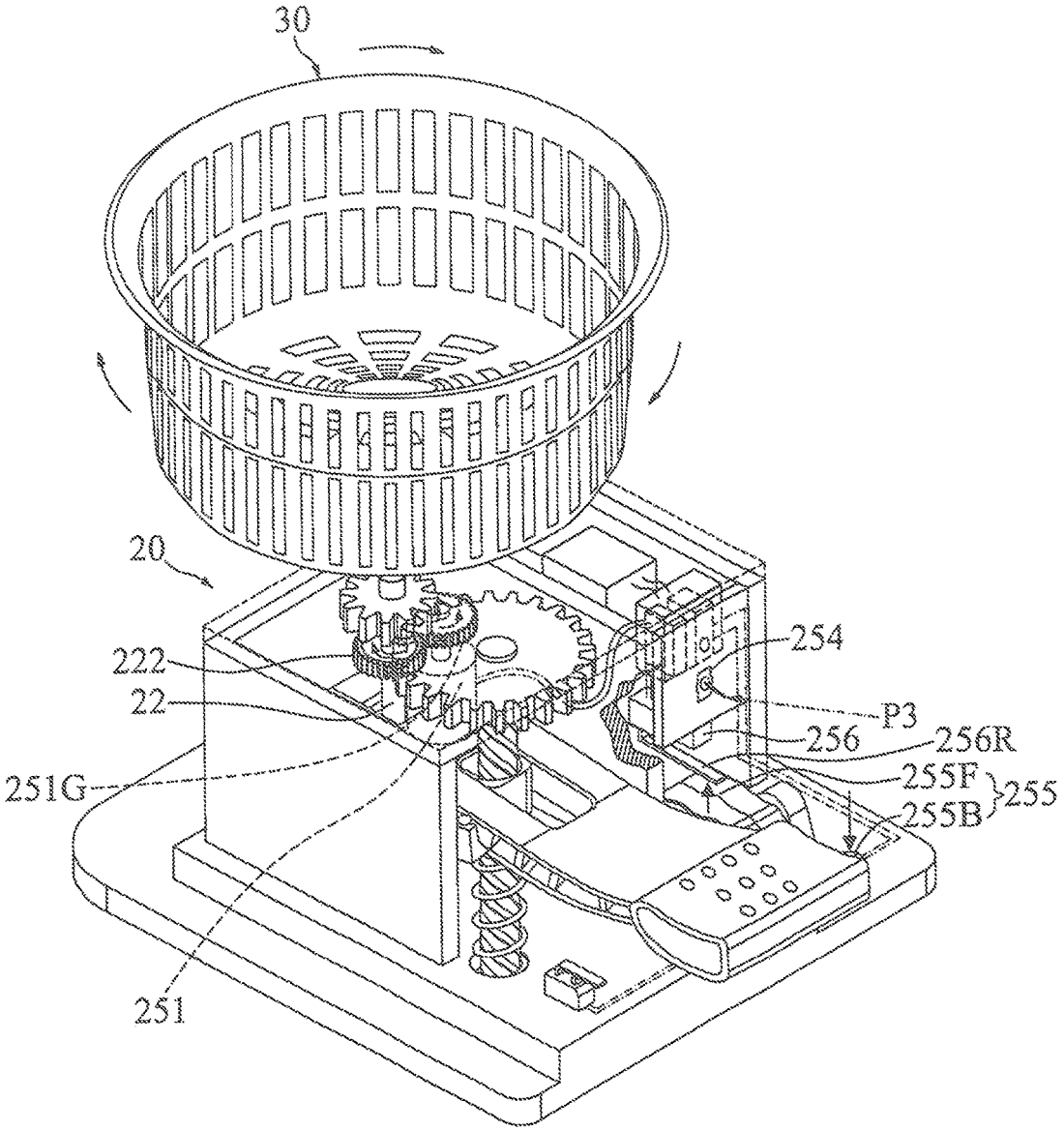
FIG. 6 is a perspective view showing the operation of the electrical and foot-operated dewater device at a third actuation position according to the preferred embodiment of the present invention.

With reference to FIG. 6, when the control switch 254 is set at the third actuation position P3, the dewater device 1 is operated in the electrical driving mode. For example, the rear stepping portion 255B of the second pedal 255 is stepped so that the front stepping portion 255F of the second pedal 255 moves upwardly and presses the second control lever 256R of the second touch switch 256, thus starting the electrical driving mode. Thereafter, the actuation gear 251G of the motor 251 rotates so as to drive the rotary shaft 22 and the bucket 30 to revolve.

While the first embodiments of the invention have been set forth for the purpose of disclosure, modifications of the disclosed embodiments of the invention as well as other embodiments thereof may occur to those skilled in the art. The scope of the claims should not be limited by the first embodiments set forth in the examples, but should be given the broadest interpretation consistent with the description as a whole.

What is claimed is:

1. An electrical and foot-operated dewater device comprising: a bucket, a dewatering unit, and a draining basket;

the bucket including a holding portion and a groove portion, the groove portion being separated from the holding portion;

the dewatering unit being mounted in the groove portion of the bucket, and the dewatering unit including a base, a rotary shaft rotatably fixed on the base, a foot-operated driving assembly configured to drive the rotary shaft to revolve, a first touch switch, and an electrical driving assembly;

the draining basket being housed in the holding portion of the bucket and being rotatably connected with the rotary shaft;

wherein the rotary shaft includes a first gear portion and a second gear portion, the foot-operated driving assembly includes a transmission part, a first pedal, and a resilient element, wherein the transmission part has a worm, a fitting sleeve, and a drive gear, wherein the worm is rotatably fixed on the base, the fitting sleeve is fitted on the worm, and the resilient element is fitted on the worm and is located below the fitting sleeve, the drive gear is disposed on one end of the worm and meshes with the first gear portion of the rotary shaft, and the first pedal is configured to drive the transmission part;

wherein the first touch switch is secured below the first pedal;

wherein the electrical driving assembly is configured to drive the rotary shaft to revolve, and the electrical driving assembly includes a motor, a circuit controller, a battery, and a control switch, wherein the motor meshes with the second gear portion of the rotary shaft, and the motor includes a coupling post and an actuation gear meshing with the second gear portion of the rotary shaft, wherein the circuit controller is electrically connected with the motor and the first touch switch, the battery is electrically connected with the circuit controller, and the control switch is electrically connected with the circuit controller so as to switch an electrical driving mode and a foot-operated driving mode;

wherein the circuit controller includes a charging circuit module, the charging circuit module includes a socket configured to connect with an external power supply so as to electrify the battery, and the charging circuit module receives electricity produced by the motor in the foot-operated driving mode;

wherein the first touch switch includes a first control lever defined between the first pedal and the base, between the first control lever and the first pedal is defined a spacing, and between the first pedal and the base is defined a moving distance, wherein the spacing is less than the moving distance, and the first touch switch matches with the first pedal so as to start the electrical driving mode.

2. The electrical and foot-operated dewater device as claimed in claim 1, wherein the control switch has a first actuation position and a second actuation position, the first actuation position corresponds to the foot-operated driving mode, and the second actuation position corresponds to the electrical driving mode, wherein the control switch further has a third actuation position corresponding to the electrical driving mode.

3. The electrical and foot-operated dewater device as claimed in claim 1, wherein the electrical driving assembly further includes a second pedal and a second touch switch, the second pedal is arranged on the base, and a rear stepping portion of the second pedal is lower than a bottom plane of the first pedal, wherein the second touch switch corresponds to the second pedal and is electrically connected with the circuit controller; wherein the second pedal has a front stepping portion and a rear stepping portion, the second touch switch has a second control lever located above the front stepping portion, and the second touch switch matches with the second pedal so as to start the electrical driving mode.

* * * * *